US006567631B2

(12) United States Patent
Funayama et al.

(10) Patent No.: US 6,567,631 B2
(45) Date of Patent: May 20, 2003

(54) TONER CARTRIDGE AND IMAGE FORMING APPARATUS

(75) Inventors: Naotaka Funayama, Tenri (JP); Jun Yamaguchi, Ikoma (JP); Yoshiaki Sanada, Ikoma (JP); Tsutomu Nagata, Hirakata (JP); Takahiko Kimura, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/987,658

(22) Filed: Nov. 15, 2001

(65) Prior Publication Data

US 2002/0064395 A1 May 30, 2002

(30) Foreign Application Priority Data

Nov. 24, 2000 (JP) ..... 2000-358247

(51) Int. Cl.[7] ..... G03G 21/00
(52) U.S. Cl. ..... 399/120; 399/359
(58) Field of Search ..... 399/120, 359, 399/358

(56) References Cited

U.S. PATENT DOCUMENTS

| | | | | |
|---|---|---|---|---|
| 5,778,296 A | * | 7/1998 | van der Steen et al. | 399/360 |
| 6,167,227 A | * | 12/2000 | Fujita et al. | 399/258 |
| 6,405,009 B1 | * | 6/2002 | Shinkawa et al. | 399/253 |

FOREIGN PATENT DOCUMENTS

| | | |
|---|---|---|
| JP | 4-237079 | 8/1992 |
| JP | 5-341697 | 12/1993 |
| JP | 8-44179 | 2/1996 |

* cited by examiner

*Primary Examiner*—Quana M. Grainger
(74) *Attorney, Agent, or Firm*—Birch, Stewart, Kolasch & Birch, LLP

(57) ABSTRACT

A toner cartridge includes: a toner storage chamber; a toner collecting chamber; a partitioning wall for separating these chambers; a cylindrical return pipe penetrating through the partitioning wall with a conveyer screw arranged therein and is configured so that when the amount of untransferred toner collected into the toner collecting chamber exceeds the height of the return pipe, the untransferred toner is conveyed by the rotation of the conveyer screw to be returned into the toner storage chamber.

9 Claims, 6 Drawing Sheets

TONER CARTRIDGE AND IMAGE FORMING APPARATUS

This nonprovisional application claims priority under 35 U.S.C. §119(a) on Patent Application No. 2000-358247 filed in Japan on Nov. 24, 2000, which is herein incorporated by reference.

BACKGROUND OF THE INVENTION (1) Field of the Invention

The present invention relates to a toner cartridge for storing fresh toner for development therein, and attached to, and used for, a developing unit of an image forming apparatus such as a copier, printer, facsimile machine and the like. More detailedly, the invention is directed to a toner cartridge wherein a collecting chamber for collecting untransferred toner left over on the photoconductor surface after transfer of toner images is arranged on one side of the storage chamber of the fresh toner, as well as relating to an image forming apparatus using this toner cartridge.

(2) Description of the Prior Art

Image forming apparatus such as a copier, printer, facsimile machine and the like form images by an exposure step where exposing the surface of a photoconductor such as a photoconductor drum, photoconductor belt or the like, to light forms a desired electrostatic latent image, a development step for making the thus formed static latent image visible with toner, a transfer step for transferring the formed toner image to the predetermined paper and a fixing step for fixing the transferred toner image on the paper with heat. The exposure, development and transfer steps are sequentially performed by the exposure unit, developing unit and transfer unit, respectively, all being arranged around the photoconductor.

The developing unit has a developer roller which is closely opposed to the photoconductor surface and rotates about an axis parallel to that surface. The toner for development is adapted to uniformly adhere to the whole surface of the developer roller on the side opposite to the photoconductor, is conveyed by the rotation of the developer roller and attracted to the latent image on the photoconductor surface by the function of static electricity. In such a developing unit, the toner is consumed by its adherence to the photoconductor so that the toner needs to be supplied. This supply is performed by fitting a toner cartridge that stores an appropriate amount of toner to the mount adaptively designed to the developing unit.

Part of toner attracted to the photoconductor surface from the developing unit is untransferred to the paper at the subsequent, transfer unit and remains thereon. Such untransferred toner needs to be removed from the photoconductor surface and collected before the next cycle of exposure and development. For this purpose, use of a toner cartridge for toner supply has been conventionally made in which a toner storage chamber for storing fresh toner and a toner collecting chamber arranged on one side of the toner storage chamber with a partitioning wall in between so that the untransferred toner collected from the photoconductor is kept in the toner collecting chamber and the collected untransferred toner can be disposed of when the toner cartridge is replaced for supplying the toner.

In a toner cartridge of this type, the volume of the toner collecting chamber is determined based on the expected amount of untransferred toner to arise during transfer. However, the actual amount of untransferred toner to be collected varies depending on usage and environmental conditions such as variations in toner charge performance, print paper types and the like. In addition, when, for example, jamming of print paper (paper jam) occurs, the toner adhering on the photoconductor surface at that point is collected in its entirety as the untransferred toner. Thus, there is a risk that the actual amount may markedly increase due to occurrence of inevitable malfunctions.

Under these circumstances, the volume of the toner collecting chamber needs to be designed to be large enough so as to be on the safe side of the expected amount of untransferred toner generated, giving priority to prevention of the collected untransferred toner leaking outside. This therefore results in a large configuration of toner cartridge, giving rise to a problem of constraint on the design flexibility of the image forming apparatus due to reservation of the attachment space of the toner cartridge.

Various proposals have been made in order to solve this problem. FIG. 1 is a perspective view showing an image forming apparatus configuration disclosed in Japanese Patent Application Laid-Open Hei 4 No.237079. This image forming apparatus includes a toner cartridge comprised of a toner storage chamber (toner container) 101 for storing fresh toner, a toner collecting chamber (waste toner container) 102 for collecting untransferred toner on one side of the toner storage container, a partitioning wall 103 for separating these chambers and a toner passage window 104 formed on the wall and sealed by a shutter which is opened by the force acting from the toner collecting chamber 102 side.

In the drawing, 105 designates a photoconductor drum and 106 designates a cleaning unit for removing untransferred toner left over on the peripheral side of photoconductor drum 105 after transfer. This cleaning unit 106 is connected to toner collecting chamber 102 by way of a collecting pipe 107 incorporating a coil wire as a conveyer means. The untransferred toner removed by cleaning unit 106 is conveyed into toner collecting chamber 102 passing through the collecting pipe 107 and kept in the toner collecting chamber 102.

According to this configuration, if the collected amount of untransferred toner increases and toner collecting chamber 102 has become full of toner, the shutter that seals the toner passage window 104 as an opening of partitioning wall 103 is released by the pressure of the untransferred toner, applied from the toner collecting chamber side 102 so that part of the untransferred toner in toner collecting chamber 102 returns to toner storage chamber 101 via toner passage window 104. Accordingly, it is possible to prevent untransferred toner from leaking outside while keeping the volume of toner collecting chamber 102 small, thus alleviating the aforementioned problem.

The untransferred toner returned to toner storage chamber 101 is mixed with the fresh toner and reused. In this case, the untransferred toner is unstable with regard to its charge characteristics and may cause degradation of image quality due to its reuse, but the influence on the image quality is small when the amount of return is trivial.

As already stated above, in this configuration, the shutter that seals toner passage window 104 is adapted to be released by the pressure of the untransferred toner collected in toner collecting chamber 102. In order to assure this opening action and make the untransferred toner move smoothly, it is necessary to provide optimal design of the shutter opening and closing mechanism and optimal arrangement of the opening position of toner passage window 104. When an insufficient amount of untransferred toner is returned, there is a possibility of the untransferred toner in toner collecting chamber 102 leaking outside. In contrast, when an excessive amount of untransferred toner is returned, there is the aforesaid problem that degradation of image quality due to the reuse is inevitable.

FIG. 2 is a perspective view showing a configuration of an image forming apparatus disclosed in Japanese Patent Application Laid-Open Hei 8 No.44179. This image forming apparatus includes a toner cartridge comprised of a toner storage chamber (supply toner reservoir) 111 for storing fresh toner, a toner collecting chamber (waste toner reservoir) 112 for collecting untransferred toner on one side of the toner storage chamber, a partitioning wall 113 for partitioning these chambers and a conveyer auger 114 extending across these two chambers, penetrating through the partitioning wall 113.

When this toner cartridge is attached to the predetermined position of the image forming apparatus, toner collecting chamber 112 is connected to a toner collecting pipe 116 via a toner collecting port 115 which opens on the top face at one side (the side farthest from toner storage chamber 111) while toner storage chamber 111 is connected to an unillustrated developing device via a toner supply port 117 which opens on the bottom face at the other side (the side farthest from toner collecting chamber 112). Auger 114 is coupled to a drive source inside the image forming apparatus so that it axially rotates by the driving force from the drive source.

In this toner cartridge, the fresh toner inside toner storage chamber 111 is conveyed toward toner supply port 117 as indicated by the arrow E in the drawing whilst it is being agitated by the rotation of auger 114 so that the toner is supplied to the developing device through toner supply port 117. The untransferred toner removed from the unillustrated photoconductor surface after transfer is collected through toner collecting pipe 116 and toner collecting port 115 into toner collecting chamber 112. The thus collected toner is conveyed in the toner collecting chamber 112 by auger 114 toward partitioning wall 113 which keeps the collecting chamber away from toner storage chamber 111, as indicated by the arrow F, so that the toner will be stacked successively from the toner storage chamber 111 side or from the side farthest from toner collecting port 115.

According to this configuration, the untransferred toner collected in toner collecting chamber 112 is kept efficiently, being evenly distributed inside toner collecting chamber 112. That is, it is possible for even a toner collecting chamber 112 of a small volume to collect a higher amount of untransferred toner therein, thus alleviating the above-mentioned problem. A configuration of enhancing the collecting efficiency by arranging a conveyer means inside the toner collecting chamber in the same way as above except for a variational conveyer means is disclosed in, for example, Japanese Patent Application Laid-Open Hei 5 No.341697.

However, in this configuration, it is impossible to collect untransferred toner in an amount markedly exceeding the volume of toner collecting chamber 112. In order to deal with a sharp increase in the amount of untransferred toner unexpectedly generated due to occurrence of malfunctions, it is necessary to design the volume of toner collecting chamber 112 so as to be large enough therefor, which makes it impossible to fully meet the demand for reduction in size of toner cartridges.

The untransferred toner introduced into toner collecting chamber 112 is conveyed by a conveyer means such as auger 114 or the like and is stacked whilst being successively pressed against partitioning wall 113 that keeps the collecting chamber away from toner storage chamber 111. As a result, the drive load on the conveyer means sharply increases with increase in the collected amount. In particular, when auger 114 as a conveyer means is also used for the agitator and conveyer means for the fresh toner inside toner storage chamber 111 as shown in FIG. 2, the sharp increase in drive load may obstruct fresh toner supply to the developing device and there is even a risk of deteriorating image quality.

SUMMARY OF THE INVENTION

The present invention has been devised under the above circumstances, and it is therefore an object of the present invention to provide a toner cartridge which is markedly compact compared to conventional toner cartridges and can collect untransferred toner removed from the photoconductor, adequately enough to deal with increase in the amount of untransferred toner attributed to abrupt malfunctions, but in a range in which degradation of image quality will not occur, whilst keeping the volume of a toner collecting chamber arranged on one side of a toner storage chamber as small as possible. The present invention is also directed to an image forming apparatus using this toner cartridge.

In order to achieve the above object, the present invention is configured as follows:

First, the first aspect of the present invention resides in a toner cartridge comprising: a toner storage chamber for storing fresh toner; a toner collecting chamber disposed on the side of, and separated by a partitioning wall from, the toner storage chamber, for collecting the untransferred toner removed from the photoconductor; a toner passage disposed at a predetermined height penetrating through the partitioning wall and establishing communication between the toner storage chamber and the toner collecting chamber; and a toner conveyer means disposed inside the toner passage for conveying the untransferred toner input from the toner collecting chamber side toward the toner storage chamber.

In accordance with the second aspect of the present invention, the toner cartridge having the above first feature is characterized in that the toner passage is configured of a pipe-like passage having openings at both ends for allowing communication between the toner storage chamber and toner collecting chamber, and the toner conveyer means is configured of a rotor that rotates about the axis inside the pipe-like passage to convey the untransferred toner.

Next, in accordance with the third aspect of the present invention, the toner cartridge having the above first feature is characterized in that a sealing element or a pair of sealing elements removably attached are provided for the passage opening or openings at one or both ends of the toner passage.

In accordance with the fourth aspect of the present invention, the toner cartridge having the above first feature is characterized in that a sealing element or a pair of sealing elements are provided for the passage opening or openings at one or both ends of the toner passage and are adapted to move to release the passage opening or openings in linkage with the action of the toner conveyer means.

Finally, the fifth aspect of the present invention resides in an image forming apparatus comprising: a developing unit for making the electrostatic latent image formed on the photoconductor visible; a transfer unit for transferring the toner image developed by the developing device to the printing material; a cleaning unit for removing the untransferred toner remaining on the photoconductor surface after transfer by the transfer unit; a toner cartridge removably mounted to a position so as to be associated with the developing unit and cleaning unit, in order to supply the fresh toner stored in a toner storage chamber to the developing unit and collect the untransferred toner removed by the cleaning unit into the toner collecting chamber, wherein the toner cartridge comprises: a toner storage chamber for storing fresh toner; a toner collecting chamber disposed on the side of, and separated by a partitioning wall from, the toner storage chamber, for collecting the untransferred toner removed from the photoconductor; a toner passage disposed at a predetermined height penetrating through the partitioning wall and establishing communication between the toner storage chamber and the toner collecting chamber; and a toner conveyer means disposed inside the toner passage for conveying the untransferred toner input from the toner collecting chamber side toward the toner storage chamber.

In the present invention, the untransferred toner removed from the photoconductor surface after the transfer step is collected in the toner collecting chamber and stacked therein, and when the stacked amount reaches the predetermined upper limit level, the toner enters from one end of the toner passage, formed at the predetermined height corresponding to this upper limit level, penetrating through the partitioning wall that keeps the collecting chamber away from the toner storage chamber and is conveyed toward the toner storage chamber by the action of the toner conveyer means so as to be returned at the other end into the toner storage chamber. If the upper limit level is determined so as to correspond to the expected amount of untransferred toner, only the untransferred toner exceeding this expected amount is introduced into the toner passage and returned to the toner storage chamber, thus providing simple control of the return amount. Therefore, it is possible to keep the volume of the toner collecting chamber as small as possible and collect the untransferred toner removed from the photoconductor adaptively and adequately including any increment due to abrupt malfunctions.

Further, in the present invention, a pipe element penetrating through the partitioning wall between the toner storage chamber and toner collecting chamber is arranged as the toner passage while a toner conveyer means (waste toner conveyer device) that rotates about the axis inside the toner passage is arranged. Thereby, as this waste toner conveyer device rotates, the untransferred toner (waste toner) introduced into the toner passage is assuredly conveyed and returned into the toner storage chamber.

Also, in the present invention, the passage opening or openings at one or both ends of the toner passage are covered with a removable sealing element or elements so that the fresh toner stored in the toner storage chamber is prevented from flowing back to the toner collecting chamber by way of the toner passage during handling from its manufacture till its setting into the image forming apparatus.

Further, in the present invention, the passage opening or openings at one or both ends of the toner passage are covered with a sealing element or elements so that the fresh toner stored in the toner storage chamber is prevented from flowing into the toner collecting chamber by way of the toner passage during handling from its manufacture till its setting into the image forming apparatus. In addition, the sealing element or elements are opened in linkage with the action of the toner conveyer means after the cartridge has been set into the image forming apparatus, so as to open the passage openings to thereby allow untransferred toner to return.

Finally, the present invention provides a compact image forming apparatus configuration which is free from toner leakage and degradation in image quality by using a compact toner cartridge of the present invention which can be removably attached into the mounted position in association with the developing unit consuming the fresh toner and the cleaning unit removing untransferred toner and has a toner collecting chamber of a minimum volume but which is enough to realize reliable collection of untransferred toner.

DESCRIPTION OF THE PREFERRED EMBODIMENTS

Figure 1:
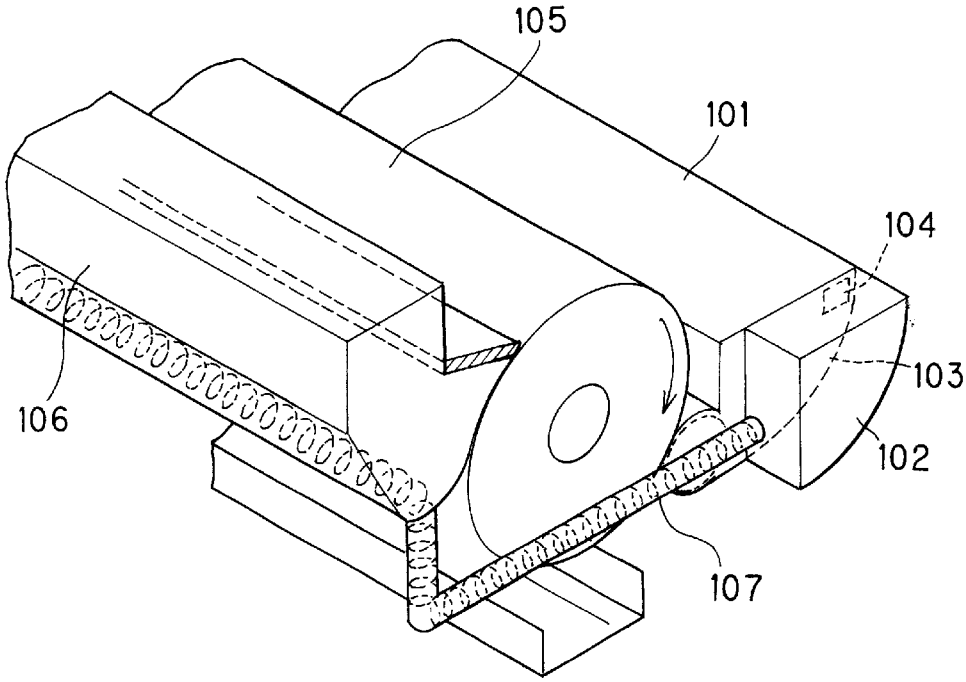
FIG. 1 PRIOR ART
FIG. 1 is a perspective view showing essential components of a conventional image forming apparatus.
Figure 2:
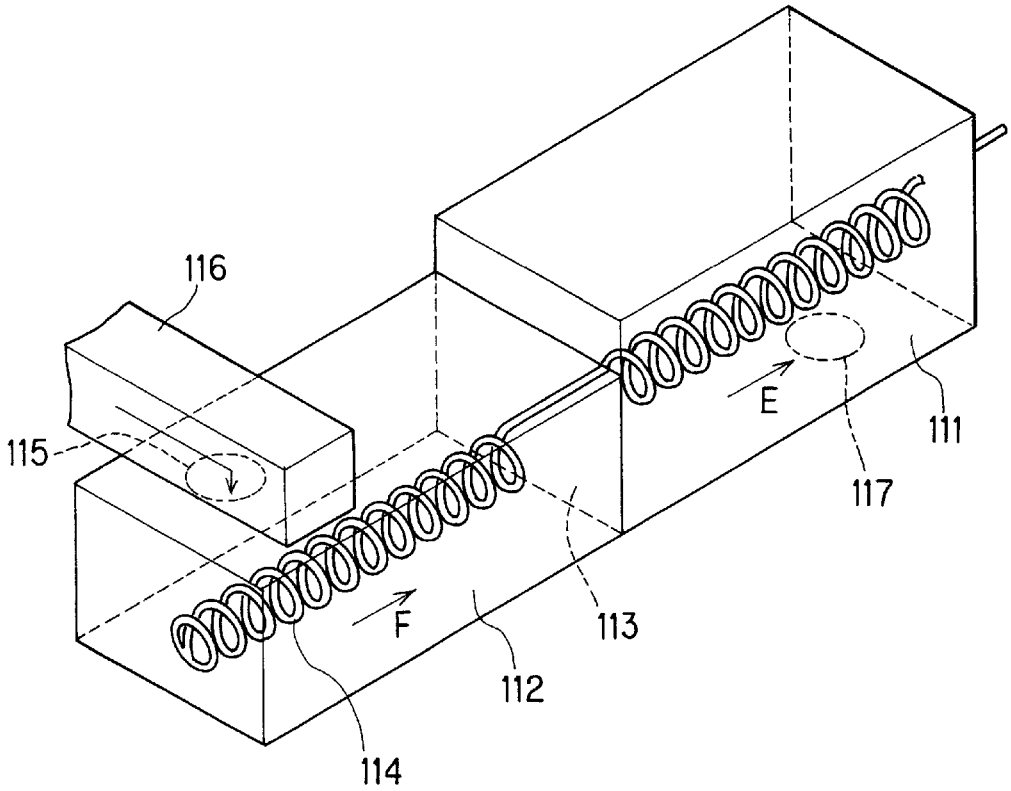
FIG. 2 PRIOR ART
FIG. 2 is a perspective view showing essential components of another conventional image forming apparatus.
Figure 3:
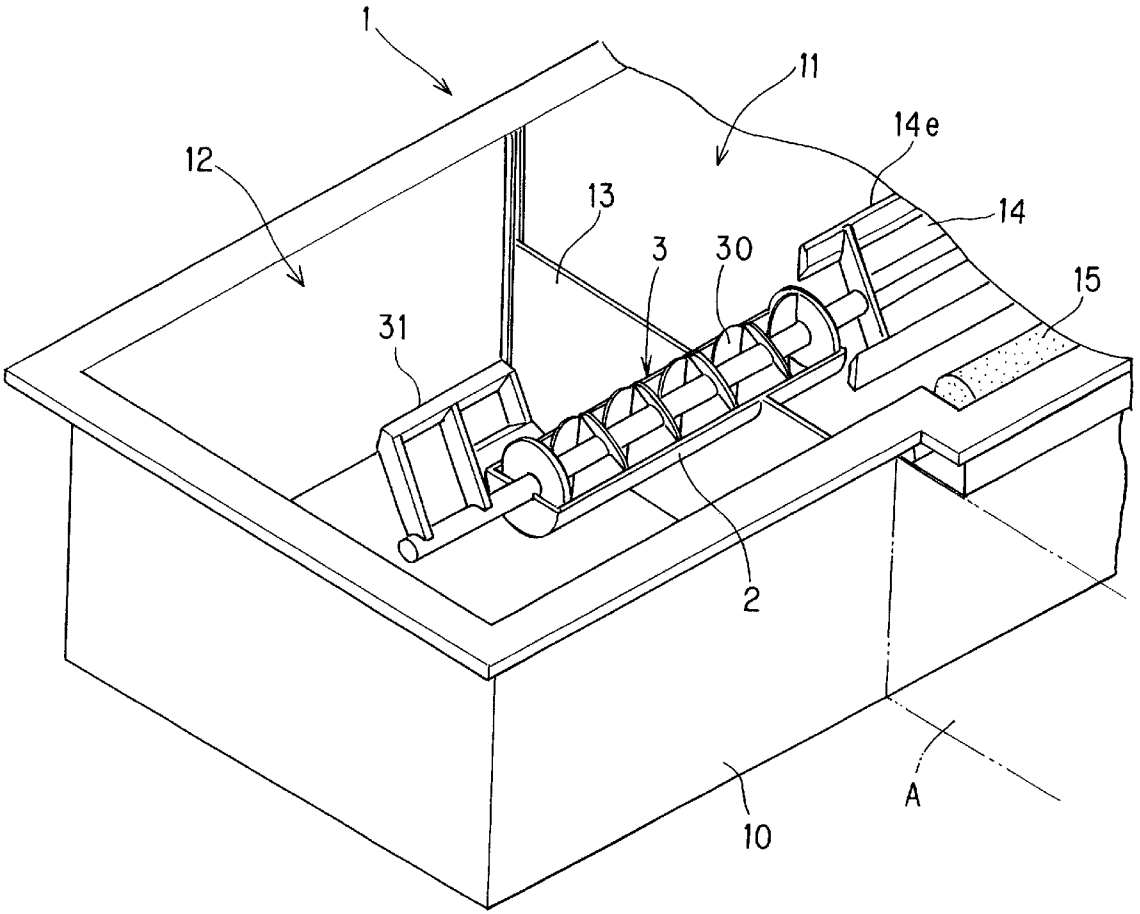
FIG. 3 is a partly cutout perspective view showing essential components of a toner cartridge according to the present invention.
Figure 4:
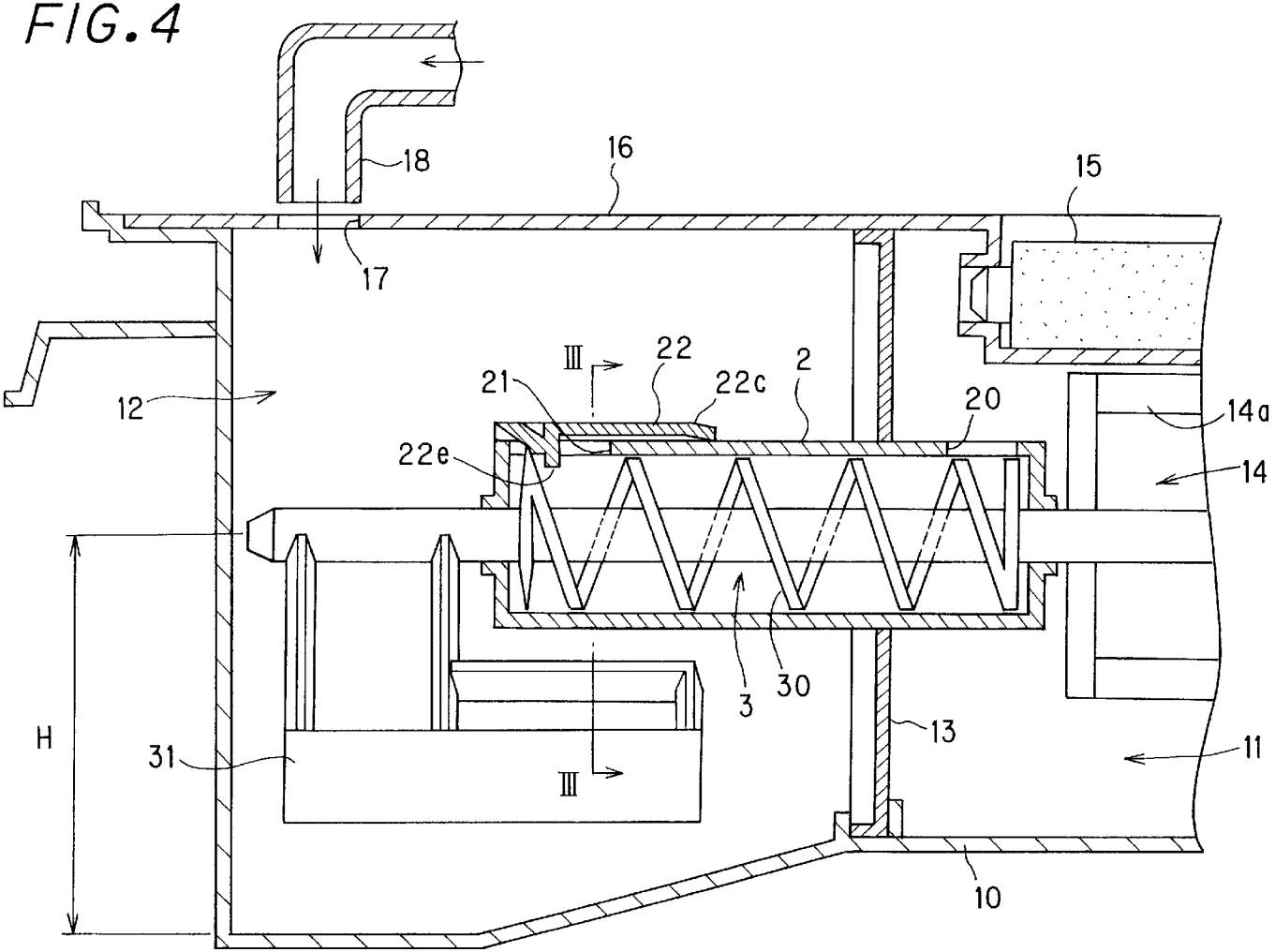
FIG. 4 is a sectional side view showing essential components of a toner cartridge according to the present invention.

The present invention will hereinafter be described in detail with reference to the drawings illustrating the embodiment. FIG. 3 is a partly cutout perspective view showing essential components of a toner cartridge according to the present invention. FIG. 4 is a sectional side view showing essential components of a toner cartridge according to the present invention.

As shown in the figures, a toner cartridge 1 according to the present invention is comprised of an outer housing 10 formed in a rectangular box-like shape, in which a toner storage chamber 11 for storing fresh toner and a toner collecting chamber 12 for collecting untransferred toner are laid out side by side with a partitioning wall 13 provided therebetween. Here, FIG. 3 shows the state with the top plate removed from outer housing 10.

Arranged at the approximate center with respect to the width of toner storage chamber 11 is an agitator 14, which is supported by a shaft extending in the longitudinal direction and has agitator blades 14*a* projected radially outwardly from the periphery of the shaft. A toner supply roller 15 is supported in parallel with the agitator 14 on one side with respect to the width of toner storage chamber 11. The agitator 14 and toner supply roller 15 are arranged projectively outside from the end wall of toner storage chamber 11 on the side opposite to partitioning wall 13. When toner cartridge 1 is set at the predetermined position in the image forming apparatus, the unillustrated associated projected ends are coupled to corresponding drive sources, so that these elements will be able to rotate about their axes by the driving forces from the drive sources.

As agitator 14 rotates, it agitates fresh toner stored in toner storage chamber 11 by agitator blades 14*a* projectively formed at the periphery while toner supply roller 15 delivers out the agitated fresh toner into a developing unit A (indicated by two-dot chain line in FIG. 3) positioned in proximity to toner cartridge 1. Agitator blades 14*a* at the periphery of agitator 14 are configured of a multiple number of rungs radially bidirectionally projected from the shaft and spaced appropriately with respect to the length of the shaft and a pair of longitudinal bars each crossed by the rungs, as shown in the drawing, so that fresh toner can be agitated by the rotation of agitator 14 without receiving strong friction.

As shown in FIG. 4, a top plate 16 covering the top of outer housing 10 has a toner collecting port 17 that opens at the top of toner collecting chamber 12. This toner collecting port 17 is positioned so as to oppose the terminal end of a toner collecting pipe 18 inside the image forming apparatus when toner cartridge 1 is set at the predetermined position in the image forming apparatus.

Toner collecting pipe 18 is connected to the cleaning unit for removing untransferred toner left over after transfer of toner images on the surface of the unillustrated photoconductor in the image forming apparatus. The removed untransferred toner is conveyed through the toner collecting pipe 18 by the function of an appropriate conveyer means and is introduced into toner collecting chamber 12 via toner collecting port 17 opposing the terminal end.

Fixed at a predetermined height H (see FIG. 4) from the bottom of toner collecting chamber 12 and penetrating through the partitioning wall 13 dividing toner storage chamber 11 and toner collecting chamber 12 is a cylindrical return pipe (toner passage) 2. This return pipe 2 is projected with appropriate lengths into both chambers 11 and 12. Supported coaxially inside the return pipe 2 is a waste toner conveyer element 3 which is composed of semielliptic feed plates 30, 30, . . . arranged alternately on both sides of the shaft and inclined at a predetermined angle so as to form a simulated feed screw configuration.

In the illustrated toner cartridge 1, the waste toner conveyer element 3 is integrally coupled on the axis in common with that of agitator 14 arranged across toner storage chamber 11 and is rotated with the rotation of agitator 14, so that this rotation causes the feed plates 30 to spirally advance from the toner storage chamber 12 side to the toner collecting chamber 11 side.

In this way, the shaft of waste toner conveyer element 3 is extended to the interior of toner collecting chamber 12 penetrating through the end wall of return pipe 2. This extended part has an agitator blade 31 formed integrally thereon, which is configured of two rungs radially projected from the shaft and spaced appropriately with respect to the length of the shaft and a longitudinal bar crossed by distal ends of the rungs, in the same manner as the agitator blades 14*a*. This agitator blade 31 is caused to rotate by the rotation of waste toner conveyer element 3 and agitator 14 so that the untransferred toner collected in toner collecting chamber 12 in the aftermentioned manner is agitated and leveled in order to prevent the untransferred toner from amassing and being distributed unevenly.

Formed at the one end of return pipe 2 projected into toner storage chamber 11 is a discharge opening 20, which is cut out in the upper half of the pipe. At the other end of return pipe 2 projected into toner collecting chamber 12 an input opening 21 is formed similarly so as to open in the upper half of the pipe. This input opening 21 is sealed in an openable and closable manner by a slide cover 22 which slides along the outer surface of return pipe 2.

Figure 5:
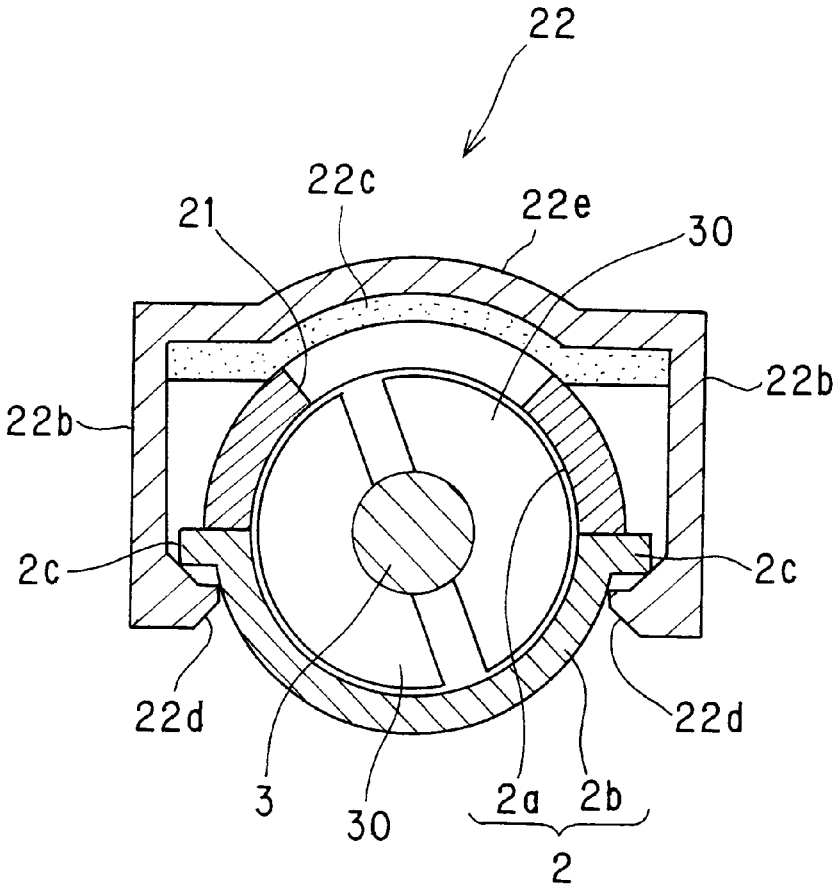
FIG. 5 is a cross-section cut along a plane III—III in FIG. 4.

FIG. 5 is a cross-section taken along a plane III—III in FIG. 4, showing the attachment of slide cover 22 as the sealing element. As shown in this drawing, return pipe 2 is constructed of a combination of upper and lower pipe elements 2*a* and 2*b*, both having a semicircular section, butted to each other at their common axis, thus forming a circular pipe. Formed at the butt joint portions of lower pipe element 2*b* are flanges 2*c* and 2*c* protruding radially outwardly. The aforementioned input opening 21 is formed by cutting out, to a predetermined width, in the peripheral side of upper pipe 2*a*. Here, FIG. 3 shows the state with upper pipe 2*a* removed.

Slide cover 22 has a cover plate 22*a* formed coaxially fitting over the outer periphery of upper pipe 2*a* and a pair of support legs 22*b*, 22*b* projected in the same direction from the side edges of the cover plate 22*a* and has a saddle shape cross-section, cut along a plane perpendicular to the axis, as shown in FIG. 5. Applied on the inner surface of cover plate 22*a* is a sliding sheet 22*c* made up of a porous elastic material which is excellent in sliding and sealing performances. The thus configured slide cover 22 is placed over the outer side of upper pipe 2*a* with the projected side of support legs 22*b*, 22*b* downwards and the distal ends of support legs 22*b*, 22*b* on both sides are bent inward forming engagement claws 22*d*, 22*d* to be engaged with the aforesaid flanges 2*c*, 2*c* so that the slide cover is attached with sliding sheet 22*c* on the inner surface of cover plate 22*a* pressed against the outer surface of upper pipe 2*a*.

The thus attached slide cover 22 is able to slide in the longitudinal direction whilst sliding sheet 22*c* is sliding over the surface of pipe 2*a*, with engagement claws 22*d*, 22*d* guided along flanges 2*c*, 2*c* of lower pipe 2*b*, whereby the input opening 21 formed in upper pipe 2*a* is made open and closed. As shown in FIG. 4, a projected portion 22*e* projected into return pipe 2 is formed at one end of slide cover 22. The distal end of this projected portion 22*e* is engaged with the outer periphery of feedplate 30 of the waste toner conveyer element 3 which rotates inside return pipe 2.

Figure 6A:
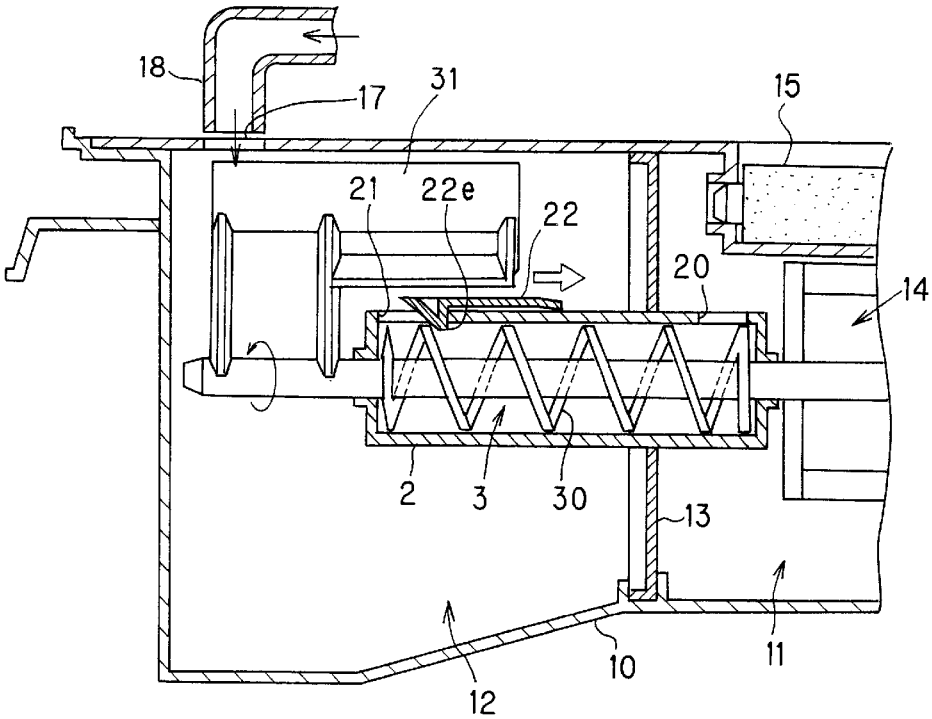
FIGS. 6A and 6B are illustrative views for illustrating the opening and closing movements of a slide cover.
Figure 6B:
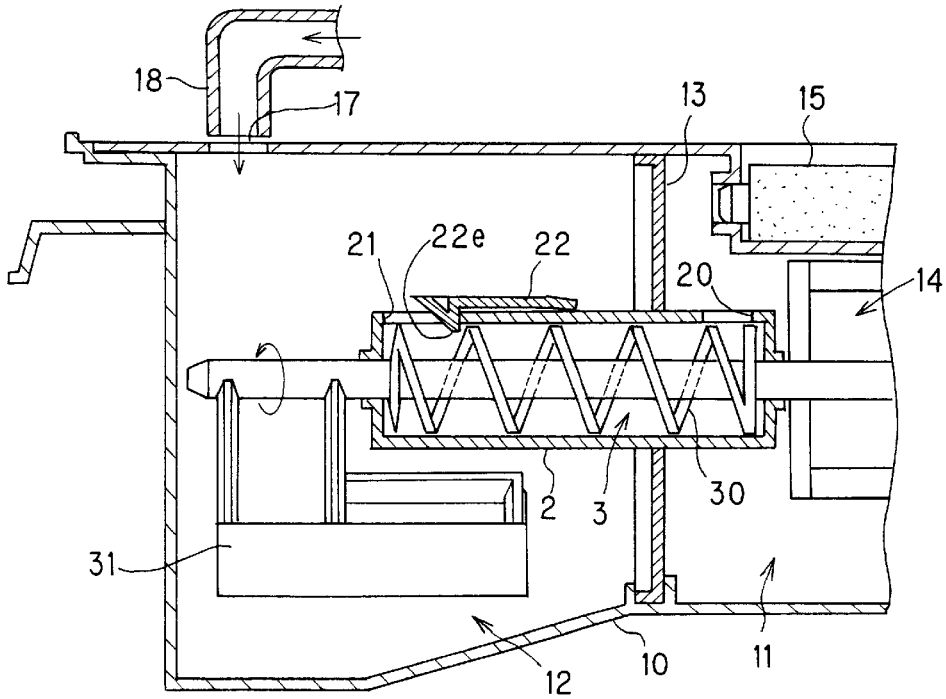

FIGS. 6A and 6B are illustrative views showing the opening and closing actions of slide cover 22. Slide cover 22 is assembled so as to seal over the entire area of input opening 21 formed in return pipe 2, as shown in FIG. 4. In the usage state where toner cartridge 1 has been set as stated above, as waste toner conveyer element 3 rotates in the direction of the arrow shown in FIGS. 6A and 6B, this rotation causes the feed plate 30 to push projected portion 22*e* on the inner side of slide cover 22 so that the slide cover 22 slides in the direction of the outlined arrow in FIG. 6A to open the input opening 21. After input opening 21 has been fully opened, the projected portion 22*e* is located at a space (see FIG. 5) between adjacent feed plates 30 and 30, so that the slide cover 22 is kept at the open position as shown in FIG. 6B, without impeding the rotation of waste toner conveyer element 3.

In this way, in the illustrated toner cartridge 1, input opening 21 on one side of return pipe 2 is sealed by slide cover 22 in the assembly stage so as to shut off the communication between toner storage chamber 11 and toner collecting chamber 12. Accordingly, if, for example, the cartridge is incorrectly handled during transport, after assembly or during storage, before usage, there is no fear of the fresh toner stored beforehand in toner storage chamber 11 leaking out into toner collecting chamber 12 via return pipe 2, hence it is possible to use the fresh toner entirely.

Since input opening 21 is automatically opened by the movement of slide cover 22 in linkage with the rotation of waste toner conveyer element 3 after the above-described setting of toner cartridge 1, it is possible to establish communication between toner storage chamber 11 and toner collecting chamber 12 without failure after the start of usage.

Slide cover 22 may be arranged so as to open and close discharge opening 20 in toner storage chamber 11, or may be provided at both the discharge opening 20 and input opening 21. Sealing tape may be used to seal either discharge opening 20 or input opening 21 or both of them so that when the cartridge starts to be used, the sealing tape will be peeled off from outside to thereby open the discharge opening 20 and input opening 21.

After the start of usage of toner cartridge 1, the thus configured toner collecting chamber 12 collects the untransferred toner, which is removed from the photoconductor surface by the function of the cleaning unit as already described and conveyed via toner collecting pipe 18 and toner collecting portion 17. The thus collected untransferred toner is agitated by the rotating agitator blade 31 provided at the extended portion of waste toner conveyer element 3 and stacked approximately uniformly inside toner collecting chamber 12.

The collected amount of untransferred toner in toner collecting chamber 12 may increase as stated above due to deterioration of the usage and environmental conditions of the image forming apparatus, and in particular it may sharply increase due to occurrence of malfunctions such as paper jam, etc. If the accumulated depth of untransferred toner inside toner collecting chamber 12 increases due to increase in the collected amount and the surface level exceeds the set height H of return pipe 2, the topmost untransferred toner is introduced into return pipe 2 via input opening 21 that opens to toner collecting chamber 12 and conveyed toward toner storage chamber 11 by the rotation of waste toner conveyer element 3 arranged inside the return pipe 2 and returned into toner storage chamber 11 via discharge opening 20 that opens at the end part on the storage chamber 11 side.

In the toner cartridge 1 thus configured according to the present invention, untransferred toner collected in toner collecting chamber 12 builds up inside toner collecting chamber 12 until the surface level reaches the upper limit level corresponding to the set height H of return pipe 2. When a large amount of untransferred toner exceeding the upper limit level is collected, the excess is returned to toner storage chamber 11 by way of return pipe 2.

Therefore, by designating the set height H of return pipe 2 at a height corresponding to the expected amount of untransferred toner generated under a preferred usage environment, the untransferred toner in excess of this expected amount is returned to toner storage chamber 11. In this way, it is possible to deal with increase in the amount of untransferred toner due to deterioration of usage environment or due to malfunctions, without making the volume of toner collecting chamber 12 excessively large, thus making it possible to provide a compact toner cartridge 1 having a toner storage chamber 11 and toner collecting chamber 12.

The expected amount of untransferred toner generation can be determined if the transfer efficiency in the transfer step is known. The transfer efficiency under ideal usage conditions is 85 to 90%. For example, if the transfer efficiency is assumed to be 85% and the effective amount of untransferred toner stored in toner storage chamber 11 is 725 g as will be described later, the expected amount of untransferred toner generation is calculated as 108.75 g (725×0.15).

In the present invention, since untransferred toner returned from toner collecting chamber 12 to toner storage chamber 11 is introduced into return pipe 2 and then assuredly conveyed by the rotation of waste toner conveyer element 3, the amount of return can be easily regulated and there is no fear of the untransferred toner inside toner collecting chamber 12 leaking outside. Since the waste toner conveyer element 3 is coupled coaxially with agitator 14 inside toner storage chamber 11, the power drive mechanism from the driving source inside the image forming apparatus can be shared, which makes the arrangement simple.

Untransferred toner returned to toner storage chamber 11 is mixed with the fresh toner stored in toner storage chamber 11 and agitated and fed into developing device A to be used again. Untransferred toner is unstable in its charge characteristics so that degradation of image quality due to its reuse is inevitable. But, in the present invention, untransferred toner is not reused as long as the normal usage conditions hold, and even when an anomaly occurs, the returned amount of untransferred toner is kept to the minimum, so that the influence on image quality is extremely small.

Finally, the sequential flow from the assembly and shipment of the thus configured toner cartridge 1 to the start of usage by a user and its replacement on the user side will be described. In the assembly and shipment stage, toner storage chamber 11 is filled up with 745 g of fresh toner. In this stage, input opening 21 at the end portion of return pipe 2 is sealed by slide cover 22. Therefore, there is no fear that the fresh toner charged in the toner storage chamber 11 might leak into toner collecting chamber 12 via return pipe 2 during transport or storage after assembly and shipment, by external causes such inevitable vibration, casual handling, etc.

The charged amount of fresh toner, 745 g, is the standard amount of toner required for 25000 copies or prints, plus the amount of remaining toner (=20) left inside toner storage chamber 11 when toner cartridge 1 will be replaced.

This toner cartridge 1 is set into the predetermined position in the image forming apparatus such as a copier, printer and facsimile machine. At this point, waste toner conveyer element 3 inside return pipe 2 is coupled together with agitator 14 inside toner storage chamber 11 to the power drive mechanism on the image forming apparatus side and is rotationally driven as the image forming apparatus starts operating. This rotation of toner conveyer element 3 causes slide cover 22 to slide as shown in FIG. 6A so as to fully open the input opening 21 at the end portion of return pipe 2 as shown in FIG. 6B, thus establishing communication between toner storage chamber 11 and toner collecting chamber 12. The only user operation needed upon the start of usage is the above-said setting of toner cartridge 1.

In the case where image forming has been done with normal transfer efficiency (equal to or greater than 85%) in the transfer step in using the image forming apparatus thereafter, 108.75 g (=725 g×0.15) of untransferred toner (waste toner) arises. This untransferred toner is collected into toner collecting chamber 12 via toner collecting pipe 18 and toner collecting port 17 and accumulates in toner collecting chamber 12. The depth of the stack of the standard amount (=108.75 g) of untransferred toner is approximately equal to the upper limit level H. Therefore, no untransferred toner will be returned from released input opening 21 through return pipe 2 into toner storage chamber 11 if the amount is equal to or lower than the standard amount. In this case, toner conveyer element 3 inside return pipe 2 rotates idly.

However, the transfer efficiency in actual usage conditions may lower, down to more or less 65% depending upon usage and environmental conditions such as variations in toner charge characteristics, types of print paper, etc., so that the amount of untransferred toner generation may increase. The amount of untransferred toner generation will further increase if the malfunctions such as jamming of print paper (paper jam) occur.

In such a case, in toner cartridge 1 of the present invention, the collected amount of untransferred toner exceeds the aforementioned standard amount (108.75 g), hence the depth of the stack inside toner collecting chamber 12 will exceed the aforementioned upper limit level H so that part of the accumulated untransferred toner falls into return pipe 2 through the released input opening 21 and is conveyed by the rotation of toner conveyer element 3 inside return pipe 2 and returned into toner storage chamber 11 through discharge opening 20 which is opened at the other end of return pipe 2.

For example, if toner transfer in the transfer step is performed at a level as low as a transfer efficiency of 65% as mentioned above, 253.75 g (=725×0.35) of untransferred toner arises. In this case, untransferred toner in the amount equivalent to the excess (253.75−108.75=145 g) from the standard amount is returned into toner storage chamber 11, which means that it is possible for toner collecting chamber 12, which falls short of the volume needed for 253.75 g of toner, to collect that amount of untransferred toner.

As already stated, the actual volume of toner that collecting chamber 12 is capable of collecting when the volume of untransferred toner is 253.75 g, arising when the transfer efficiency is 65%, should be determined depending on the rate of toner conveyance by toner conveyer element 3. For example, when the toner is conveyed by toner conveyer element 3 at a rate of 1 g/min, toner collecting chamber 12 needs to be capable of storing a volume of 217.5 g of toner. When the rate of toner conveyance is 2 g/min, it is sufficient for toner collecting chamber 12 to have a volume equivalent to 172.5 g of toner.

Thus, as the rate of toner conveyance by toner conveyer element 3 becomes greater, the volume of toner collecting chamber 12 can be made smaller, hence providing an advantage in respect of making toner cartridge 1 compact. However, if the rate of toner conveyance is set at too a large value, the mixing ratio of the untransferred toner to the remaining fresh toner in toner storage chamber 11 becomes high when in the so-called life of end state where the fresh toner remaining in toner storage chamber 11 is low in amount, increasing the risk of image defects (black spots, black stripes, etc.) background degradation, toner scattering and other various degradations. Therefore, the rate of toner conveyance by toner conveyer element 3 needs to be determined appropriately in accordance with the performance, usage status of the target machine, hence the necessary volume of toner collecting chamber 12 ought to be designated based on the determination of that rate.

In the toner cartridge according to the present invention as has been described in detail heretofore, when the untransferred toner collected in the toner collecting chamber exceeds the predetermined upper limit level, the toner enters the toner passage provided at the height corresponding to the upper limit level and is conveyed by the action of the toner conveyer means to be returned into the toner storage chamber. Therefore, by designating the upper limit level at a height corresponding to the expected amount of untransferred toner generated under a preferred usage condition, it is possible to securely collect untransferred toner whilst keeping the volume of the toner collecting chamber as small as possible, hence make it possible to provide atoner cartridge markedly reduced in size compared to the conventional configuration without causing any toner leakage.

Further, in the toner cartridge according to the present invention, the toner passage is configured of a pipe-like passage having openings at both ends for allowing communication with the toner storage chamber and toner collecting chamber, and the waste toner conveyer device that rotates about the axis inside the pipe-like passage is arranged. Therefore, it is possible to assuredly return untransferred toner from the toner collecting chamber to the toner storage chamber.

Also, in the toner cartridge according to the present invention, since a sealing element or a pair of sealing elements, removably attached, are provided for the passage opening or openings at one or both ends of the toner passage, the fresh toner stored in the toner storage chamber will not flow back to the toner collecting chamber by way of the toner passage during handling from its manufacture till its setting into the image forming apparatus, thus making possible to eliminate waste consumption of the fresh toner.

In the toner cartridge according to the present invention, since a sealing element or a pair of sealing elements are provided for the passage opening or openings at one or both ends of the toner passage, the fresh toner stored in the toner storage chamber will not flow back to the toner collecting chamber by way of the toner passage during handling from its manufacture till its setting into the image forming apparatus, thus making possible to eliminate waste consumption of the fresh toner. In addition, since the sealing element or elements automatically release the passage opening or openings in linkage with the action of the toner conveyer means, it is possible to assuredly make untransferred toner return without the necessity of any releasing action when the toner cartridge is set into the image forming apparatus.

In the image forming apparatus according to the present invention, since the toner cartridge of the present invention which is compact and still enables reliable collection of untransferred toner is used, it is possible to realize an apparatus markedly compact and free from toner leakage and degradation of image quality.

What is claimed is:

1. A toner cartridge comprising:

a toner storage chamber for storing fresh toner;

a toner collecting chamber disposed on the side of, and separated by a partitioning wall from, the toner storage chamber, for collecting the untransferred toner removed from the photoconductor;

a toner passage disposed at a predetermined height penetrating through the partitioning wall and establishing communication between the toner storage chamber and the toner collecting chamber, so that the untransferred toner can pass from the toner collecting chamber to the toner storage chamber; and a toner conveyer means disposed inside the toner passage for conveying the untransferred toner input from the toner collecting chamber side toward the toner storage chamber.

2. The toner cartridge according to claim 1, wherein the toner passage is a pipe passage having openings at both ends for allowing communication between the toner storage chamber and toner collecting chamber, and the toner conveyer means is configured of a rotor that rotates about the axis inside the pipe passage to convey the untransferred toner.

3. A toner cartridge comprising:

a toner storage chamber for storing fresh toner;

a toner collecting chamber disposed on the side of, and separated by a partitioning wall from, the toner storage chamber, for collecting the untransferred toner removed from the photoconductor;

a toner passage disposed at a predetermined height penetrating through the partitioning wall and establishing communication between the toner storage chamber and the toner collecting chamber; and a toner conveyer means disposed inside the toner passage for conveying the untransferred toner input from the toner collecting chamber side toward the toner storage chamber, wherein a sealing element or a pair of sealing elements removably attached are provided for the passage opening or openings at one or both ends of the toner passage.

4. A toner cartridge comprising:

a toner storage chamber for storing fresh toner;

a toner collecting chamber disposed on the side of, and separated by a partitioning wall from, the toner storage chamber, for collecting the untransferred toner removed from the photoconductor;

a toner passage disposed at a predetermined height penetrating through the partitioning wall and establishing communication between the toner storage chamber and the toner collecting chamber; and a toner conveyer means disposed inside the toner passage for conveying the untransferred toner input from the toner collecting chamber side toward the toner storage chamber, wherein a sealing element or a pair of sealing elements are provided for the passage opening or openings at one or both ends of the toner passage and are adapted to move to release the passage opening or openings in linkage with the action of the toner conveyor means.

5. An image forming apparatus comprising:

a developing unit for making the electrostatic latent image formed on the photoconductor visible;

a transfer unit for transferring the toner image developed by the developing device to the printing material;

a cleaning unit for removing the untransferred toner remaining on the photoconductor surface after transfer by the transfer unit;

a toner cartridge removably mounted to a position so as to be associated with the developing unit and cleaning unit, in order to supply the fresh toner stored in a toner storage chamber to the developing unit and collect the untransferred toner removed by the cleaning unit into the toner collecting chamber, wherein the toner cartridge comprises:

a toner storage chamber for storing fresh toner;

a toner collecting chamber disposed on the side of, and separated by a partitioning wall from, the toner storage chamber, for collecting the untransferred toner removed from the photoconductor;

a toner passage disposed at a predetermined height penetrating through the partitioning wall and establishing communication between the toner storage chamber and the toner collecting chamber; and a toner conveyor means disposed inside the toner passage for conveying the untransferred toner input from the toner collecting chamber side into the toner storage chamber.

6. A toner cartridge comprising:

a toner storage chamber for storing fresh toner;

a toner collecting chamber disposed on the side of, and separated by a partitioning wall from, the toner storage chamber, for collecting the untransferred toner removed from the photoconductor;

a toner passage disposed at a predetermined height penetrating through the partitioning wall and establishing communication between the toner storage chamber and the toner collecting chamber; and a toner conveyer means disposed inside the toner passage for conveying the untransferred toner input from the toner collecting chamber side toward the toner storage chamber, wherein the toner passage is a pipe having openings at both ends, one end in the toner storage chamber, the other end in the toner collecting chamber for allowing communication between the toner storage chamber and toner collecting chamber, and the toner conveyer means is a rotor that rotates about an axis inside the pipe to convey the untransferred toner.

7. A toner cartridge comprising:

a toner storage chamber for storing fresh toner;

a toner collecting chamber disposed on the side of, and separated by a partitioning wall from, the toner storage chamber, for collecting the untransferred toner removed from the photoconductor;

means disposed at a predetermined height penetrating through the partitioning wall and establishing communication between the toner storage chamber and the toner collecting chamber, so that the untransferred toner can flow from the toner collecting chamber to the toner storage chamber; and a toner conveyer means disposed inside the toner passage for conveying the untransferred toner input from the toner collecting chamber side toward the toner storage chamber.

8. The toner cartridge according to claim 2, further including a slidable cover for the pipe.

9. The toner cartridge according to claim 6, further including a slidable cover for the pipe.

* * * * *